US009777722B2

(12) United States Patent
Hines et al.

(10) Patent No.: US 9,777,722 B2
(45) **Date of Patent: *Oct. 3, 2017**

(54) PULSELESS POSITIVE DISPLACEMENT PUMP AND METHOD OF PULSELESSLY DISPLACING FLUID

(71) Applicant: Graco Minnesota Inc., Minneapolis, MN (US)

(72) Inventors: Bradley H. Hines, Andover, MN (US); Brian W. Koehn, Minneapolis, MN (US); Jeffrey A. Earles, Lakeville, MN (US); Paul W. Scheierl, Circle Pines, MN (US); Adam K. Collins, Brooklyn Park, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/983,235

(22) Filed: Dec. 29, 2015

(65) Prior Publication Data

US 2016/0108904 A1 Apr. 21, 2016

Related U.S. Application Data

(63) Continuation of application No. 14/579,618, filed on Dec. 22, 2014.

(Continued)

(51) Int. Cl.
*F04B 45/047* (2006.01)
*F04B 43/04* (2006.01)

(Continued)

(52) U.S. Cl.
CPC ..... *F04B 45/047* (2013.01); *F04B 17/03* (2013.01); *F04B 17/044* (2013.01); *F04B 35/01* (2013.01);

(Continued)

(58) Field of Classification Search
CPC ..... F04B 45/04; F04B 45/047; F04B 45/053; F04B 43/02; F04B 43/04; F04B 43/06;

(Continued)

(56) References Cited

U.S. PATENT DOCUMENTS 1,650,377 A 11/1927 Nixon
2,407,792 A 9/1946 McMillan (Continued)

FOREIGN PATENT DOCUMENTS

EP 0781922 A1 7/1997

OTHER PUBLICATIONS

Written Opinion of International Searching Authority for PCT Application No. PCT/US2014/071950, dated Apr. 17, 2015, 8 pages.

(Continued)

*Primary Examiner* — Essama Omgba
*Assistant Examiner* — Stephen Mick
(74) *Attorney, Agent, or Firm* — Kinney & Lange, P.A.

(57) ABSTRACT

A double displacement pump includes an inlet manifold, an outlet manifold, a first fluid cavity between the inlet manifold and the outlet manifold, a second fluid cavity between the inlet manifold and the outlet manifold, and a drive system that includes a housing defining an internal pressure chamber, a piston disposed within the internal pressure chamber and having a first and second pull chambers and a central slot for receiving a drive, a first pull with a free end slidably secured within the first pull chamber and a second pull with a free end slidably secured within the second pull chamber, and a first fluid displacement member coupled to the first pull and a second fluid displacement member coupled to the second pull.

5 Claims, 8 Drawing Sheets

Related U.S. Application Data

(60) Provisional application No. 62/022,263, filed on Jul. 9, 2014, provisional application No. 61/937,266, filed on Feb. 7, 2014.

(51) Int. Cl.

| | |
|---|---|
| ***F04B 43/06*** | (2006.01) |
| ***F04B 17/04*** | (2006.01) |
| ***F04B 43/02*** | (2006.01) |
| ***F04B 45/04*** | (2006.01) |
| ***F04B 17/03*** | (2006.01) |
| ***F04B 35/04*** | (2006.01) |
| ***F04B 53/10*** | (2006.01) |
| ***F04B 35/01*** | (2006.01) |
| ***F04B 43/073*** | (2006.01) |
| ***F04B 45/053*** | (2006.01) |

(52) U.S. Cl.

CPC ..... *F04B 35/04* (2013.01); *F04B 43/02* (2013.01); *F04B 43/023* (2013.01); *F04B 43/025* (2013.01); *F04B 43/04* (2013.01); *F04B 43/06* (2013.01); *F04B 43/073* (2013.01); *F04B 45/04* (2013.01); *F04B 45/041* (2013.01); *F04B 45/053* (2013.01); *F04B 53/10* (2013.01); *F04B 53/1002* (2013.01)

(58) Field of Classification Search

CPC ..... F04B 43/025; F04B 43/073; F04B 17/03; F04B 53/10; F04B 53/1002; F04B 35/01; F04B 35/04; F04B 45/041; F04B 43/023; F04B 17/044; F16J 1/12; F16J 1/14; F16J 1/20

USPC ..... 417/53, 413.1, 535, 536

See application file for complete search history.

(56) References Cited

U.S. PATENT DOCUMENTS

| | | | | |
|---|---|---|---|---|
| 2,491,230 | A | | 12/1949 | Theis |
| 2,752,854 | A | | 7/1956 | Prior et al. |
| 3,207,080 | A | | 9/1965 | Schlosser |
| 3,250,225 | A | | 5/1966 | Taplin |
| 3,276,389 | A | | 10/1966 | Bower, Jr. |
| 3,416,461 | A | | 12/1968 | McFarland |
| 3,680,981 | A | | 8/1972 | Wagner |
| 3,741,689 | A | | 6/1973 | Rupp |
| 3,769,879 | A | | 11/1973 | Lofquist, Jr. |
| 3,775,030 | A | | 11/1973 | Wanner |
| 3,916,449 | A | | 11/1975 | Davis |
| 3,999,896 | A | | 12/1976 | Sebastiani |
| 4,008,984 | A | | 2/1977 | Scholle |
| 4,068,982 | A | | 1/1978 | Quarve |
| 4,365,745 | A | | 12/1982 | Beck |
| 4,403,924 | A | | 9/1983 | Gebauer et al. |
| 4,549,467 | A | | 10/1985 | Wilden et al. |
| 4,778,356 | A | | 10/1988 | Hicks |
| 4,883,412 | A | | 11/1989 | Malizard et al. |
| 4,902,206 | A | | 2/1990 | Nakazawa et al. |
| 5,066,199 | A | | 11/1991 | Reese et al. |
| 5,106,274 | A | | 4/1992 | Holtzapple |
| 5,145,339 | A | | 9/1992 | Lehrke et al. |
| 5,165,869 | A | | 11/1992 | Reynolds |
| 5,174,731 | A | | 12/1992 | Korver |
| 5,213,485 | A | * | 5/1993 | Wilden ..... F04B 43/0736 137/454.4 |
| 5,219,274 | A | | 6/1993 | Pawlowski et al. |
| 5,249,932 | A | | 10/1993 | Van Bork |
| 5,362,212 | A | | 11/1994 | Bowen et al. |
| 5,378,122 | A | * | 1/1995 | Duncan ..... F04B 43/0736 417/395 |
| 5,527,160 | A | | 6/1996 | Kozumplik, Jr. et al. |
| 5,567,118 | A | | 10/1996 | Grgurich et al. |
| 5,616,005 | A | | 4/1997 | Whitehead |
| 5,649,809 | A | * | 7/1997 | Stapelfeldt ..... F04B 9/045 417/413.1 |
| 5,816,778 | A | | 10/1998 | Elsey, Jr. et al. |
| 5,927,954 | A | | 7/1999 | Kennedy et al. |
| 6,106,246 | A | | 8/2000 | Steck et al. |
| 6,142,749 | A | * | 11/2000 | Jack ..... F04B 53/1002 417/395 |
| 6,158,982 | A | | 12/2000 | Kennedy et al. |
| 6,280,149 | B1 | | 8/2001 | Able et al. |
| 6,299,415 | B1 | | 10/2001 | Bahrton |
| 6,402,486 | B1 | | 6/2002 | Steck et al. |
| 7,399,168 | B1 | | 7/2008 | Eberwein |
| 7,517,199 | B2 | | 4/2009 | Reed et al. |
| 7,600,985 | B2 | | 10/2009 | Meloche et al. |
| 7,654,801 | B2 | | 2/2010 | Spude |
| 7,658,598 | B2 | | 2/2010 | Reed et al. |
| 7,758,321 | B2 | | 7/2010 | Fukano et al. |
| 8,123,500 | B2 | | 2/2012 | Juterbock et al. |
| 8,167,586 | B2 | | 5/2012 | Towne |
| 8,182,247 | B2 | | 5/2012 | Gallwey et al. |
| 8,292,600 | B2 | | 10/2012 | Reed et al. |
| 8,313,313 | B2 | | 11/2012 | Juterbock et al. |
| 8,382,445 | B2 | | 2/2013 | Roseberry |
| 8,393,881 | B2 | | 3/2013 | Usui et al. |
| 8,485,792 | B2 | | 7/2013 | McCourt et al. |
| 8,585,372 | B2 | | 11/2013 | Bacher et al. |
| 2001/0048882 | A1 | | 12/2001 | Layman |
| 2004/0057853 | A1 | | 3/2004 | Ross et al. |
| 2004/0086398 | A1 | | 5/2004 | Lehrke et al. |
| 2006/0257271 | A1 | | 11/2006 | Juterbock et al. |
| 2007/0092385 | A1 | | 4/2007 | Petrie Pe |
| 2010/0045096 | A1 | | 2/2010 | Schonlau et al. |
| 2010/0178184 | A1 | * | 7/2010 | Simmons ..... F04B 9/135 417/472 |
| 2012/0000561 | A1 | * | 1/2012 | Schuttermair ..... F15B 1/024 138/30 |
| 2012/0063925 | A1 | | 3/2012 | Parker |
| 2012/0227389 | A1 | | 9/2012 | Hinderks |
| 2013/0101445 | A1 | | 4/2013 | Schutze |
| 2013/0243630 | A1 | * | 9/2013 | Simmons ..... F04B 23/028 417/456 |
| 2015/0226206 | A1 | * | 8/2015 | Hines ..... F04B 43/04 417/53 |

OTHER PUBLICATIONS

Written Opinion of International Searching Authority for PCT Application No. PCT/US2014/071947, dated Apr. 20, 2015, 6 pages.

Advisory Action for U.S. Appl. No. 14/579,551, dated Jul. 27, 2017, 13 pages.

* cited by examiner

PULSELESS POSITIVE DISPLACEMENT PUMP AND METHOD OF PULSELESSLY DISPLACING FLUID

CROSS-REFERENCE TO RELATED APPLICATION(S)

This application is a continuation of U.S. Non-Provisional application Ser. No. 14/579,618 filed on Dec. 22, 2014, and entitled "Pulseless Positive Displacement Pump and Method of Pulselessly Displacing Fluid," which claimed priority to U.S. Provisional Application No. 62/022,263 filed on Jul. 9, 2014, and entitled "Mechanically-Driven Diaphragm Pump with Diaphragm Pressure Chamber," and which claimed priority to U.S. Provisional Application No. 61/937,266 filed on Feb. 7, 2014, and entitled "Mechanically-Driven Diaphragm Pump with Diaphragm Pressure Chamber," the disclosures of which are incorporated by reference in their entirety.

BACKGROUND

This disclosure relates to positive displacement pumps and more particularly to an internal drive system for positive displacement pumps.

Positive displacement pumps discharge a process fluid at a selected flow rate. In a typical positive displacement pump, a fluid displacement member, usually a piston or diaphragm, drives the process fluid through the pump. When the fluid displacement member is drawn in, a suction condition is created in the fluid flow path, which draws process fluid into a fluid cavity from the inlet manifold. The fluid displacement member then reverses direction and forces the process fluid out of the fluid cavity through the outlet manifold.

Air operated double displacement pumps typically employ diaphragms as the fluid displacement members. In an air operated double displacement pump, the two diaphragms are joined by a shaft, and compressed air is the working fluid in the pump. Compressed air is applied to one of two diaphragm chambers, associated with the respective diaphragms. When compressed air is applied to the first diaphragm chamber, the first diaphragm is deflected into the first fluid cavity, which discharges the process fluid from that fluid cavity. Simultaneously, the first diaphragm pulls the shaft, which is connected to the second diaphragm, drawing the second diaphragm in and pulling process fluid into the second fluid cavity. Delivery of compressed air is controlled by an air valve, and the air valve is usually actuated mechanically by the diaphragms. Thus, one diaphragm is pulled in until it causes the actuator to toggle the air valve. Toggling the air valve exhausts the compressed air from the first diaphragm chamber to the atmosphere and introduces fresh compressed air to the second diaphragm chamber, thus causing a reciprocating movement of the respective diaphragms. Alternatively, the first and second fluid displacement members could be pistons instead of diaphragms, and the pump would operate in the same manner.

Hydraulically driven double displacement pumps utilize hydraulic fluid as the working fluid, which allows the pump to operate at much higher pressures than an air driven pump. In a hydraulically driven double displacement pump, hydraulic fluid drives one fluid displacement member into a pumping stroke, while that fluid displacement member is mechanically attached to the second fluid displacement member and thereby pulls the second fluid displacement member into a suction stroke. The use of hydraulic fluid and pistons enables the pump to operate at higher pressures than an air driven diaphragm pump could achieve.

Alternatively, double displacement pumps may be mechanically operated, without the use of air or hydraulic fluid. In these cases, the operation of the pump is essentially similar to an air operated double displacement pump, except compressed air is not used to drive the system. Instead, a reciprocating drive is mechanically connected to both the first fluid displacement member and the second fluid displacement member, and the reciprocating drive drives the two fluid displacement members into suction and pumping strokes.

SUMMARY

According to one embodiment of the present invention, a pump includes an inlet manifold, an outlet manifold, a first fluid cavity disposed between the inlet manifold and the outlet manifold, a second fluid cavity disposed between the inlet manifold and the outlet manifold, and an internal pressure chamber. A first fluid displacement member sealingly separates the first fluid cavity from the internal pressure chamber, and a second fluid displacement member sealingly separates the second fluid cavity from the internal pressure chamber. Inlet check valves are disposed between the inlet manifold and the first and second fluid cavities to prevent backflow into the inlet manifold from either fluid cavity. Similarly, outlet check valves are disposed between the fluid cavities and the outlet manifold to prevent backflow from the outlet manifold to either fluid cavity. A piston is disposed within the internal pressure chamber, and the piston has a first pull chamber within a first end of the piston and a second pull chamber within a second end of the piston. The piston also has a slot for engaging a drive. A first pull has a free end and an attachment end, with the free end slidably disposed within the first pull chamber and the attachment end secured to the first fluid displacement member. A second pull has a free end and an attachment end, with the free end slidably disposed within the second pull chamber and the attachment end secured to the second fluid displacement member.

According to another embodiment, a pump includes an inlet manifold, an outlet manifold, a first fluid cavity disposed between the inlet manifold and the outlet manifold, a second fluid cavity disposed between the inlet manifold and the outlet manifold, and an internal pressure chamber. A first fluid displacement member sealingly separates the first fluid cavity from the internal pressure chamber, and a second fluid displacement member sealingly separates the second fluid cavity from the internal pressure chamber. Inlet check valves are disposed between the inlet manifold and the first and second fluid cavities to prevent backflow into the inlet manifold from either fluid cavity. Similarly, outlet check valves are disposed between the fluid cavities and the outlet manifold to prevent backflow from the outlet manifold to either fluid cavity. A drive extends into the internal pressure chamber, and a hub is disposed on the drive. The hub includes a first attachment portion and a second attachment portion. A first flexible belt connects the first attachment portion to the first fluid displacement member, and a second flexible belt connects the second attachment portion to the second fluid displacement member.

According to yet another embodiment, a method for operating a pump includes charging an internal pressure chamber with a working fluid. A drive is activated to move a driven member disposed within the internal pressure chamber. The driven member draws either of a first fluid displacement member or a second fluid displacement member into a suction stroke, and the working fluid pushes the other of the first fluid displacement member or the second fluid displacement member into a pumping stroke. Pulsation is eliminated by sequencing the drive such that one fluid displacement member is changing over from a pumping stroke to a suction stroke while the other fluid displacement member is already in a pumping stroke.

DETAILED DESCRIPTION

Figure 1:
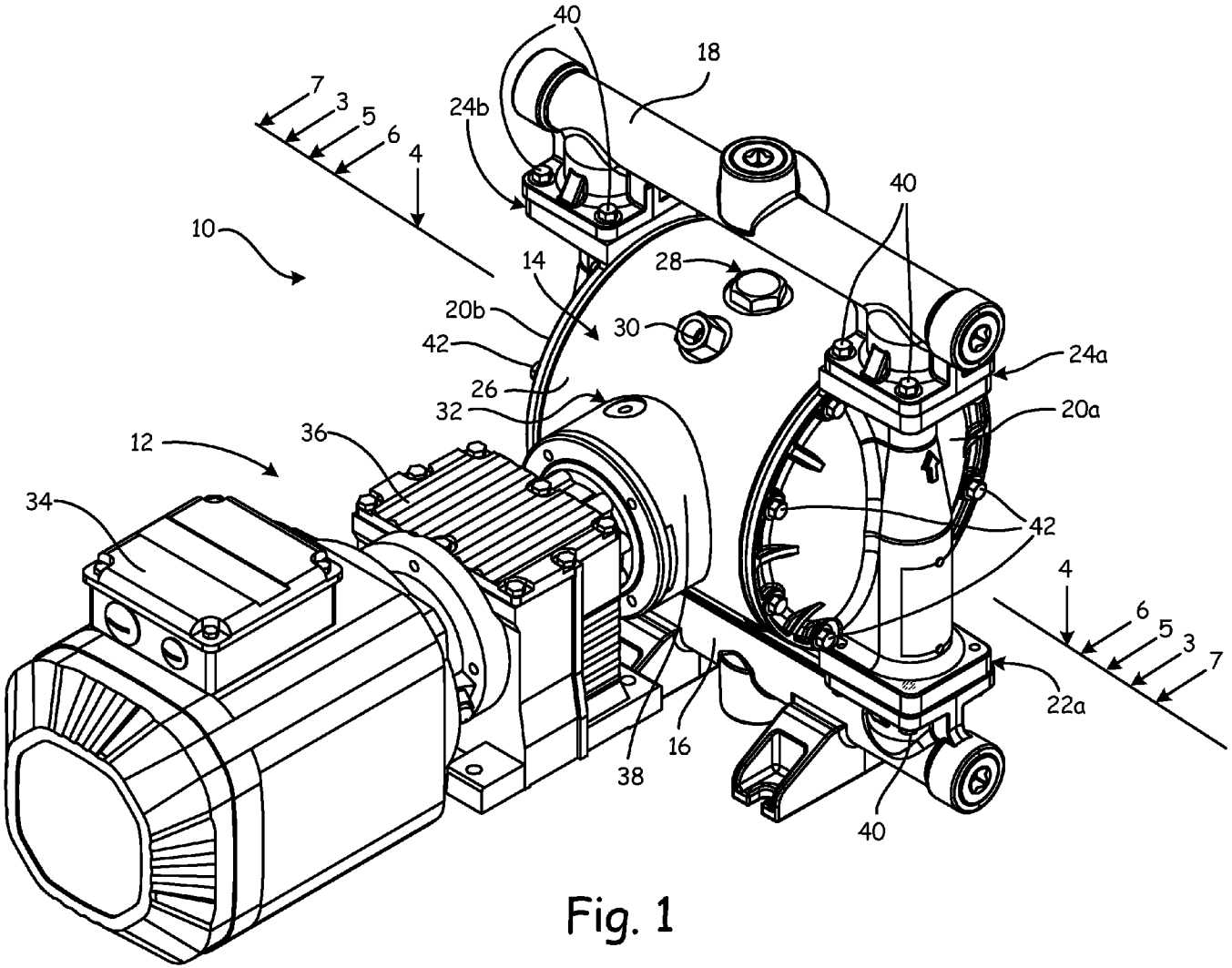
FIG. 1 is a rear perspective view of a pump, drive system, and motor.

FIG. 1 shows a perspective view of pump 10, electric drive 12, and drive system 14. Pump 10 includes inlet manifold 16, outlet manifold 18, fluid covers 20*a* and 20*b*, inlet check valves 22*a* and 22*b*, and outlet check valves 24*a* and 24*b*. Drive system 14 includes housing 26 and piston guide 28. Housing includes working fluid inlet 30 and drive chamber 32 (best seen in FIG. 2). Electric drive 12 includes motor 34, gear reduction drive 36, and drive 38.

Fluid covers 20*a* and 20*b* are attached to inlet manifold 16 by fasteners 40. Inlet check valves 22*a* and 22*b* (shown in FIG. 2) are disposed between inlet manifold 16 and fluid covers 20*a* and 20*b* respectively. Fluid covers 20*a* and 20*b* are similarly attached to outlet manifold 18 by fasteners 40. Outlet check valves 24*a* and 24*b* (shown in FIG. 2) are disposed between outlet manifold 18 and fluid covers 20*a* and 20*b*, respectively. Housing 26 is secured between fluid covers 20*a* and 20*b* by fasteners 42. Fluid cavity 44*a* (best seen in FIG. 3) is formed between housing 26 and fluid cover 20*a*. Fluid cavity 44*b* (best seen in FIG. 3) is formed between housing 26 and fluid cover 20*b*.

Motor 34 is attached to and drives gear reduction drive 36. Gear reduction drive 36 drives drive 38 to actuate pump 10. Drive 38 is secured within drive chamber 32 by fasteners 46.

Housing 26 is filled with a working fluid, either a gas, such as compressed air, or a non-compressible hydraulic fluid, through working fluid inlet 30. When the working fluid is a non-compressible hydraulic fluid, housing 26 further includes an accumulator for storing a portion of the non-compressible hydraulic fluid during an overpressurization event. As explained in more detail below, drive 38 causes drive system 14 to draw process fluid from inlet manifold 16 into either fluid cavity 44*a* or fluid cavity 44*b*. The working fluid then discharges the process fluid from either fluid cavity 44*a* or fluid cavity 44*b* into outlet manifold 18. Inlet check valves 22*a* and 22*b* prevent the process fluid from backflowing into inlet manifold 16 while the process fluid is being discharged to outlet manifold 18. Similarly, outlet check valves 24*a* and 24*b* prevent the process fluid from backflowing into either fluid cavity 44*a* or 44*b* from outlet manifold 18.

Figure 2:
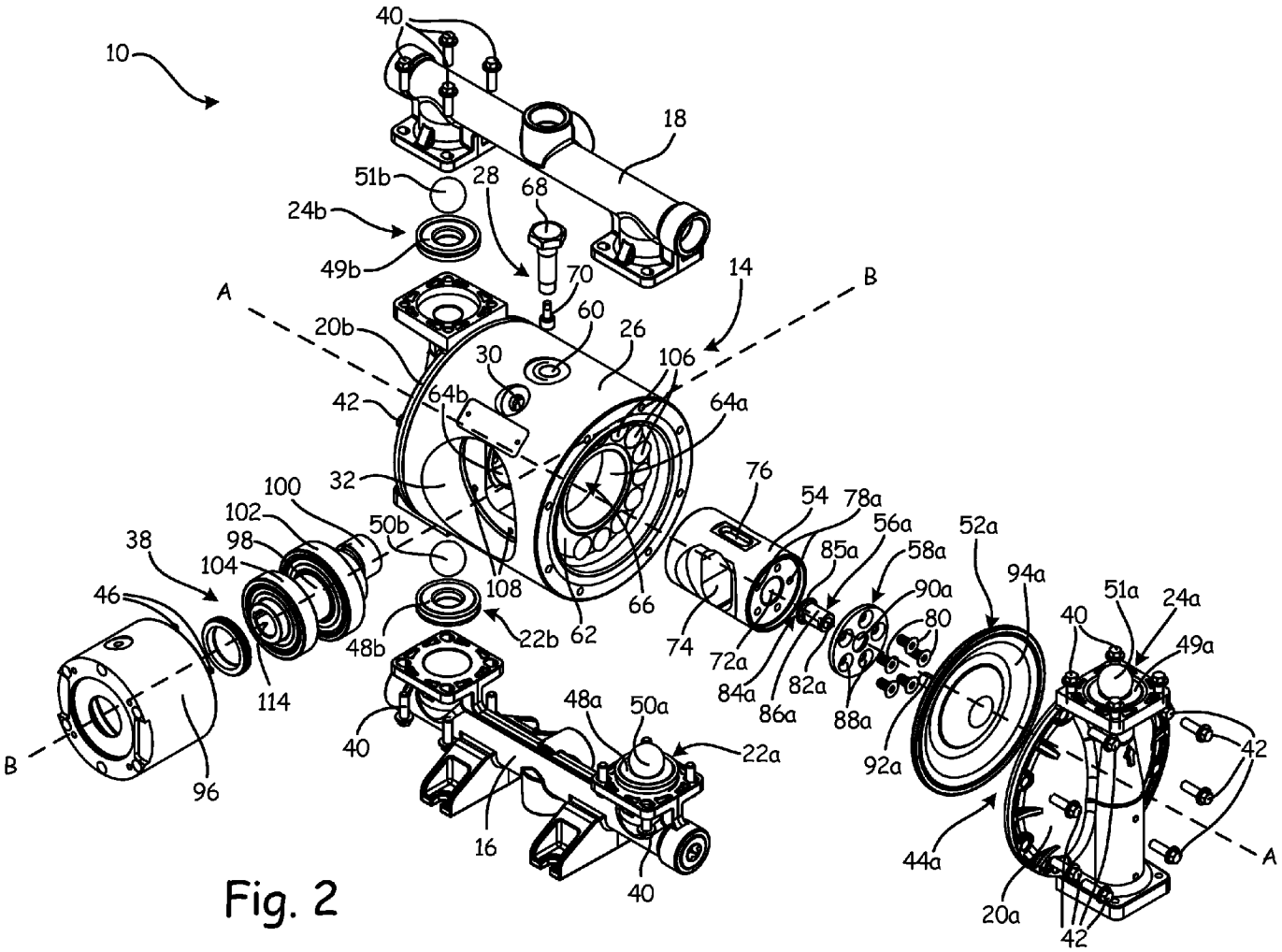
FIG. 2 is an exploded perspective view of a pump, drive system, and drive.

FIG. 2 is an exploded, perspective view of pump 10, drive system 14, and drive 38. Pump 10 includes inlet manifold 16, outlet manifold 18, fluid covers 20*a* and 20*b*, inlet check valves 22*a* and 22*b*, and outlet check valves 24*a* and 24*b*. Inlet check valve 22*a* includes seat 48*a* and check ball 50*a*, and inlet check valve 22*b* includes seat 48*b* and check ball 50*b*. Similarly, outlet check valve 24*a* include seat 49*a* and check ball 51*a*, and outlet check valve 24*b* includes seat 49*b* and check ball 51*b*. Although inlet check valves 22*a*/22*b* and outlet check valves 24*a*/24*b* are shown as ball check valves, inlet check valves 22*a*/22*b* and outlet check valves 24*a*/24*b* can be any suitable valve for preventing the backflow of process fluid.

Pump further includes fluid displacement members 52*a* and 52*b*. In the present embodiment, fluid displacement members 52*a* and 52*b* are shown as diaphragms, but fluid displacement members 52*a* and 52*b* could be diaphragms, pistons, or any other suitable device for displacing process fluid. Additionally, while pump 10 is described as a double displacement pump, utilizing dual diaphragms, it is understood that drive system 14 could similarly drive a single displacement pump without any material change. It is also understood that drive system 14 could drive a pump with more than two fluid displacement members.

Drive system 14 includes housing 26, piston guide 28, piston 54, pulls 56*a* and 56*b*, and face plates 58*a* and 58*b*. Housing 26 includes working fluid inlet 30, guide opening 60, annular structure 62, and bushings 64*a* and 64*b*. Housing 26 defines internal pressure chamber 66, which contains the working fluid during operation. In the present embodiment, the reciprocating member of drive system 14 is shown as a piston, but it is understood that the reciprocating member of drive system 14 could be any suitable device for creating a reciprocating motion, such as a scotch yoke or any other drive suitable for reciprocating within housing 26.

Piston guide 28 includes barrel nut 68 and guide pin 70. Piston 54 includes pull chamber 72*a* disposed within a first end of piston 54 and pull chamber 72*b* (shown in FIG. 3A) disposed within a second end of piston 54. Piston 54 further includes central slot 74, axial slot 76, and openings 78*a* and 78*b* (not shown) for receiving face plate fasteners 80. Pull 56*a* is identical to pull 56*b* with like numbers indicating like parts. Pull 56*a* includes attachment end 82*a*, free end 84*a*, and pull shaft 86*a* extending between attachment end 82*a* and free end 84*a*. Free end 84*a* of pull 56*a* includes flange 85*a*. Face plate 58*a* is identical to face plate 58*b* with like numbers indicating like parts. Face plate 58*a* includes fastener holes 88*a* and pull opening 90*a*. In the present embodiment, fluid displacement member 52*a* includes attachment screw 92*a* and diaphragm 94*a*. Drive 38 includes housing 96, crank shaft 98, cam follower 100, bearing 102, and bearing 104. Annular structure 62 includes openings 106 therethrough.

Inlet manifold 16 is attached to fluid cover 20*a* by fasteners 40. Inlet check valve 22*a* is disposed between inlet manifold 16 and fluid cover 20*a*. Seat 48*a* of inlet check valve 22*a* sits upon inlet manifold 16, and check ball 50*a* of inlet check valve 22*a* is disposed between seat 48*a* and fluid cover 20*a*. Similarly, inlet manifold 16 is attached to fluid cover 20*b* by fasteners 40, and inlet check valve 22*b* is disposed between inlet manifold 16 and fluid cover 20*b*. Outlet manifold 18 is attached to fluid cover 20*a* by fasteners 40. Outlet check valve 24*a* is disposed between outlet manifold 18 and fluid cover 20*a*. Seat 49*a* of outlet check valve 24*a* sits upon fluid cover 20*a* and check ball 51*a* of outlet check valve 24*a* is disposed between seat 49*a* and outlet manifold 18. Similarly, outlet manifold 18 is attached to fluid cover 20*b* by fasteners 40, and outlet check valve 24*b* is disposed between outlet manifold 18 and fluid cover 20*b*.

Fluid cover 20*a* is fixedly attached to housing 26 by fasteners 42. Fluid displacement member 52*a* is secured between housing 26 and fluid cover 20*a* to define fluid cavity 44*a* and sealingly encloses one end of internal pressure chamber 66. Fluid cover 20*b* is fixedly attached to housing 26 by fasteners 42, and fluid displacement member 52*b* is secured between housing 26 and fluid cover 20*b*. Similar to fluid cavity 44*a*, fluid cavity 44*b* is formed by fluid cover 20*b* and fluid displacement member 52*b*, and fluid displacement member 52*b* sealingly encloses a second end of internal pressure chamber 66.

Bushings 64*a* and 64*b* are disposed upon annular structure 62, and piston 54 is disposed within housing 26 and rides upon bushings 64*a* and 64*b*. Barrel nut 68 extends through and is secured within guide opening 60. Guide pin 70 is fixedly secured to barrel nut 68 and rides within axial slot 76 to prevent piston 54 from rotating about axis A-A. Free end 84*a* of pull 56*a* is slidably disposed within pull chamber 72*a* of piston 54. Pull shaft 86*a* extends through pull opening 90*a* of face plate 58*a*. Face plate 58*a* is secured to piston 54 by face plate fasteners 80 that extend through openings 88*a* and into fastener holes 78*a* of piston 54. Pull opening 90*a* is sized such that pull shaft 86*a* can slide through pull opening 90*a* but free end 84*a* is retained within pull chamber 72*a* by flange 85*a* engaging face plate 58*a*. Attachment end 82*a* is secured to attachment screw 92*a* to join fluid displacement member 52*a* to pull 56*a*.

Crank shaft 98 is rotatably mounted within housing 96 by bearing 102 and bearing 104. Cam follower 100 is affixed to crank shaft 98 such that cam follower 100 extends into housing 26 and engages central slot 74 of piston 54 when drive 38 is mounted to housing 26. drive 38 is mounted within drive chamber 32 of housing 26 by fasteners 46 extending through housing 96 and into fastener holes 108.

Internal pressure chamber 66 is filled with a working fluid, either compressed gas or non-compressible hydraulic fluid, through working fluid inlet 30. Openings 106 allow the working fluid to flow throughout internal pressure chamber 66 and exert force on both fluid displacement member 52*a* and fluid displacement member 52*b*.

Cam follower 100 reciprocatingly drives piston 54 along axis A-A. When piston 54 is displaced towards fluid displacement member 52*a*, pull 56*b* is pulled in the same direction due to flange 85*b* on free end 84*b* of pull 56*b* engaging face plate 58*b*. Pull 56*b* thereby pulls fluid displacement member 52*b* into a suction stroke. Pulling fluid displacement member 52*b* causes the volume of fluid cavity 44*b* to increase, which draws process fluid into fluid cavity 44*b* from inlet manifold 16. Outlet check valve 24*b* prevents process fluid from being drawn into fluid cavity 44*b* from outlet manifold 18 during the suction stroke. At the same time that process fluid is being drawn into fluid cavity 44*b*, the charge pressure of the working fluid in internal pressure chamber 66 pushes fluid displacement member 52*a* into fluid cavity 44*a*, causing fluid displacement member 52*a* to begin a pumping stroke. Pushing fluid displacement member 52*a* into fluid cavity 44*a* reduces the volume of fluid cavity 44*a* and causes process fluid to be expelled from fluid cavity 44*a* into outlet manifold 18. Inlet check valve 22*a* prevents process fluid from being expelled into inlet manifold 16 during a pumping stoke. When cam follower 100 causes piston 54 to reverse direction, fluid displacement member 52*a* is pulled into a suction stroke by pull 56*a*, and fluid displacement member 52*b* is pushed into a pumping stroke by the charge pressure of the working fluid in internal pressure chamber 66, thereby completing a pumping cycle.

Pull chambers 72*a* and 72*b* prevent piston 54 from exerting a pushing force on either fluid displacement member 52*a* or 52*b*. If the pressure in the process fluid exceeds the pressure in the working fluid, the working fluid will not be able to push either fluid displacement member 52*a* or 52*b* into a pumping stroke. In that overpressure situation, such as when outlet manifold 18 is blocked, drive 38 will continue to drive piston 54, but pulls 56*a* and 56*b* will remain in a suction stroke because the pressure of the working fluid is insufficient to cause either fluid displacement member 52*a* or 52*b* to enter a pumping stroke. When piston 54 is displaced towards fluid displacement member 52*a*, pull chamber 72*a* prevents pull 56*a* from exerting any pushing force on fluid displacement member 52*a* by housing pull 56*a* within pull chamber 72*a*. Allowing piston 54 to continue to oscillate without pushing either fluid displacement member 52*a* or 52*b* into a pumping stroke allows pump 10 to continue to run when outlet manifold 18 is blocked without causing any harm to the motor or pump.

Figure 3A:
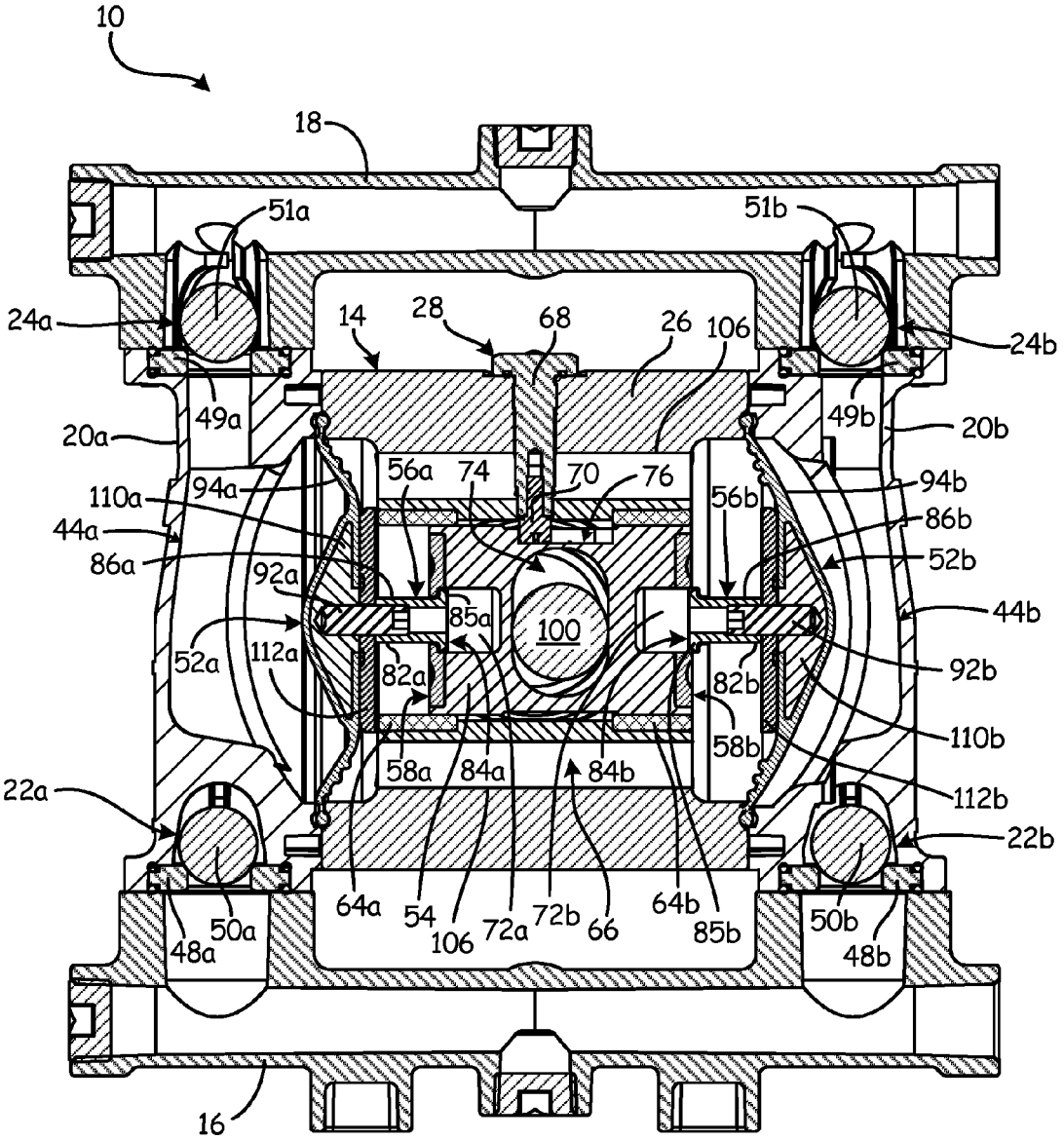
FIG. 3A is a cross-sectional view, along section 3-3 in FIG. 1, showing the connection of pump, drive system, and drive.
Figure 3B:
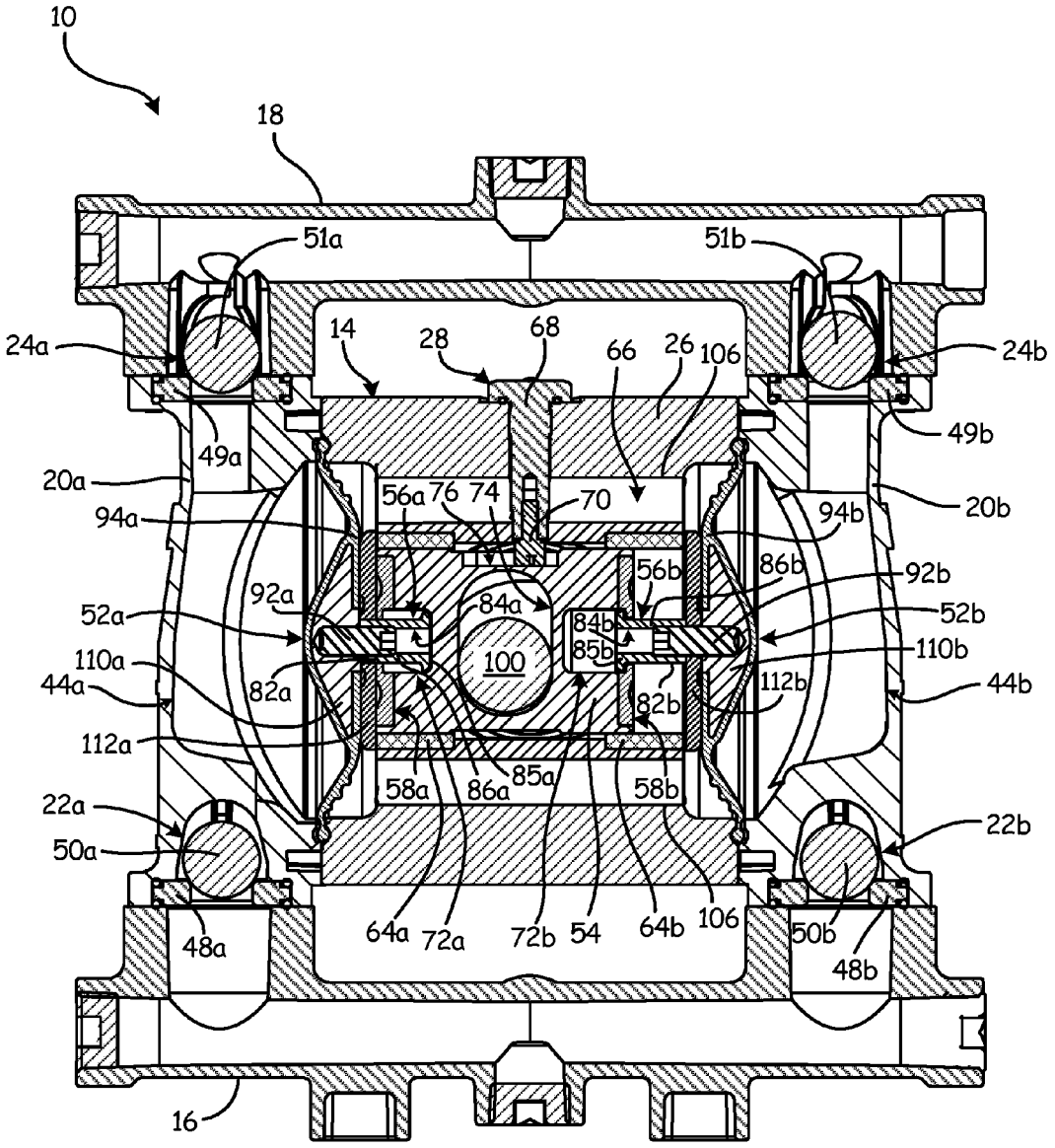
FIG. 3B is a cross-sectional view, along section 3-3 in FIG. 1, showing the connection of FIG. 3A during an over-pressurization event.

FIG. 3A is a cross-sectional view of pump 10, drive system 14, and cam follower 100 during normal operation. FIG. 3B is a cross-sectional view of pump 10, drive system 14, and cam follower 100 after outlet manifold 18 has been blocked, i.e. the pump 10 has been deadheaded. FIG. 3A and FIG. 3B will be discussed together. Pump 10 includes inlet manifold 16, outlet manifold 18, fluid covers 20*a* and 20*b*, inlet check valves 22*a* and 22*b*, outlet check valves 24*a* and 24*b*, and fluid displacement members 52*a* and 52*b*. Inlet check valve 22*a* includes seat 48*a* and check ball 50*a*, while inlet check valve 22*b* similarly includes seat 48*b* and check ball 50*b*. Outlet check valve 24*a* includes seat 49*a* and check ball 51*a*, and outlet check valve 24*b* includes seat 49*b* and check ball 51*b*. In the present embodiment, fluid displacement member 52*a* includes diaphragm 94*a*, first diaphragm plate 110*a*, second diaphragm plate 112*a*, and attachment screw 92*a*. Similarly, fluid displacement member 52*b* includes diaphragm 94*b*, first diaphragm plate 110*b*, second diaphragm plate 112*b*, and attachment screw 92*b*.

Drive system 14 includes housing 26, piston guide 28, piston 54, pulls 56*a* and 56*b*, face plates 58*a* and 58*b*, annular structure 62, and bushings 64*a* and 64*b*. Housing 26 includes guide opening 60 for receiving piston guide 28 therethrough, and housing 26 defines internal pressure chamber 66. Piston guide 28 includes barrel nut 68 and guide pin 70. Piston 54 includes pull chambers 72*a* and 72*b*, central slot 74 and axial slot 76. Pull 56*a* includes attachment end 82*a*, free end 84*a* and pull shaft 86*a* extending between free end 84*a* and attachment end 82*a*. Free end 84*a* includes flange 85*a*. Similarly, pull 56*b* includes attachment end 82*b*, free end 84*b*, and pull shaft 86*b*, and free end 84*b* includes flange 85*b*. Face plate 58*a* includes pull opening 90*a* and face plate 58*b* includes opening 90*b*.

Fluid cover 20*a* is affixed to housing 26, and fluid displacement member 52*a* is secured between fluid cover 20*a* and housing 26. Fluid cover 20*a* and fluid displacement member 52*a* define fluid cavity 44*a*. Fluid displacement member 52*a* also sealingly separates fluid cavity 44*a* from internal pressure chamber 66. Fluid cover 20*b* is affixed to housing 26 opposite fluid cover 20*a*. Fluid displacement member 52*b* is secured between fluid cover 20*b* and housing 26. Fluid cover 20*b* and fluid displacement member 52*b* define fluid cavity 44*b*, and fluid displacement member 52*b* sealingly separates fluid cavity 44*b* from internal pressure chamber 66.

Piston 54 rides on bushings 64*a* and 64*b*. Free end 84*a* of pull 56*a* is slidably secured within pull chamber 72*a* of piston 54 by flange 85*a* and face plate 58*a*. Flange 85*a* engages face plate 58*a* and prevents free end 84*a* from exiting pull chamber 72*a*. Pull shaft 86*a* extends through opening 90*a*, and attachment end 82*a* engages attachment screw 92*a*. In this way, attaches fluid displacement member 52*a* to piston 54. Similarly, free end 84*b* of pull 56*b* is slidably secured within pull chamber 72*b* of piston 54 by flange 85*b* and face plate 58*b*. Pull shaft 86*b* extends through pull opening 90*b*, and attachment end 82*b* engages attachment screw 92*b*.

Cam follower 100 engages central slot 74 of piston 54. Barrel nut 68 extends through guide opening 60 into internal pressure chamber 66. Guide pin 70 is attached to the end of barrel nut 68 that projects into internal pressure chamber 66, and guide pin 70 slidably engages axial slot 76.

Inlet manifold 16 is attached to both fluid cover 20*a* and fluid cover 20*b*. Inlet check valve 22*a* is disposed between inlet manifold 16 and fluid cover 20*a*, and inlet check valve 22*b* is disposed between inlet manifold 16 and fluid cover 20*b*. Seat 48*a* rests on inlet manifold 16 and check ball 50*a* is disposed between seat 48*a* and fluid cover 20*a*. Similarly, seat 48*b* rests on inlet manifold 16 and check ball 50*b* is disposed between seat 48*b* and fluid cover 20*b*. In this way, inlet check valves 22*a* and 22*b* are configured to allow process fluid to flow from inlet manifold 16 into either fluid cavity 44*a* and 44*b*, while preventing process fluid from backflowing into inlet manifold 16 from either fluid cavity 44*a* or 44*b*.

Outlet manifold 18 is also attached to both fluid cover 20*a* and fluid cover 20*b*. Outlet check valve 24*a* is disposed between outlet manifold 18, and fluid cover 20*a*, and outlet check valve 24*b* is disposed between outlet manifold 18 and fluid cover 20*b*. Seat 49*a* rests upon fluid cover 20*a* and check ball 51*a* is disposed between seat 49*a* and outlet manifold 18. Similarly, seat 49*b* rests upon fluid cover 20*b* and check ball 51*b* is disposed between seat 49*b* and outlet manifold 18. Outlet check valves 24*a* and 24*b* are configured to allow process fluid to flow from fluid cavity 44*a* or 44*b* into outlet manifold 18, while preventing process fluid from backflowing into either fluid cavity 44*a* or 44*b* from outlet manifold 18.

Cam follower 100 reciprocates piston 54 along axis A-A. Piston guide 28 prevents piston 54 from rotating about axis A-A by having guide pin 70 slidably engaged with axial slot 76. When piston 54 is drawn towards fluid cavity 44*b*, pull 56*a* is also pulled towards fluid cavity 44*b* due to flange 85*a* engaging face plate 58*a*. Pull 56*a* thereby causes fluid displacement member 52*a* to enter a suction stroke due to the attachment of attachment end 82*a* and attachment screw 92*a*. Pulling fluid displacement member 52*a* causes the volume of fluid cavity 44*a* to increase, which draws process fluid through check valve 22*a* and into fluid cavity 44*a* from inlet manifold 16. Outlet check valve 24*a* prevents process fluid from being drawn into fluid cavity 44*a* from outlet manifold 18 during the suction stroke.

At the same time that process fluid is being drawn into fluid cavity 44*a*, the working fluid causes fluid displacement member 52*b* to enter a pumping stroke. The working fluid is charged to a higher pressure than that of the process fluid, which allows the working fluid to displace the fluid displacement member 52*a* or 52*b* that is not being drawn into a suction stroke by piston 54. Pushing fluid displacement member 52*b* into fluid cavity 44*b* reduces the volume of fluid cavity 44*b* and causes process fluid to be expelled from fluid cavity 44*b* through outlet check valve 24*b* and into outlet manifold 18. Inlet check valve 22*b* prevents process fluid from being expelled into inlet manifold 16 during a pumping stoke.

When cam follower 100 causes piston 54 to reverse direction and travel towards fluid cavity 44*a*, face plate 58*b* catches flange 85*b* on free end 84*b* of pull 56*b*. Pull 56*b* then pulls fluid displacement member 52*b* into a suction stroke causing process fluid to enter fluid cavity 44*b* through check valve 22*b* from inlet manifold 16. At the same time, the working fluid now causes fluid displacement member 52*a* to enter a pumping stroke, thereby discharging process fluid from fluid cavity 44*a* through check valve 24*a* and into outlet manifold 18.

A constant downstream pressure is produced to eliminate pulsation by sequencing the speed of piston 54 with the pumping stroke caused by the working fluid. To eliminate pulsation, piston 54 is sequenced such that when it begins to pull one of fluid displacement member 52*a* or 52*b* into a suction stroke, the other fluid displacement member 52*a* or 52*b* has already completed its change-over and started a pumping stroke. Sequencing the suction and pumping strokes in this way prevents the drive system 14 from entering a state of rest.

Referring specifically to FIG. 3B, pull chamber 72*a* and pull chamber 72*b* of piston 54 allow pump 10 to be deadheaded without causing any damage to the pump 10 or motor 12. When pump 10 is deadheaded, the process fluid pressure exceeds the working fluid pressure, which prevents the working fluid from pushing either fluid displacement member 52*a* or 52*b* into a pumping stroke.

During over-pressurization fluid displacement member 52*a* and fluid displacement member 52*b* are retracted into a suction stroke by piston 54; however, because the working fluid pressure is insufficient to push the fluid displacement member 52*a* or 52*b* into a pumping stroke, the fluid displacement members 52*a* and 52*b* remain in the suction stroke position. Piston 54 is prevented from mechanically pushing either fluid displacement member 52*a* or 52*b* into a pumping stroke by pull chamber 72*a*, which houses pull 56*a* when the process fluid pressure exceeds the working fluid pressure and piston 54 is driven towards fluid displacement member 52*a*, and pull chamber 72*b*, which houses pull 56*b* when the process fluid pressure exceeds the working fluid pressure and piston 54 is driven towards fluid displacement member 52*b*. Housing pull 56*a* within pull chamber 72*a* and pull 56*b* within pull chamber 72*b* prevents piston 54 from exerting any pushing force on fluid displacement members 52*a* or 52*b*, which allows outlet manifold 18 to be blocked without damaging pump 10.

Figure 4:
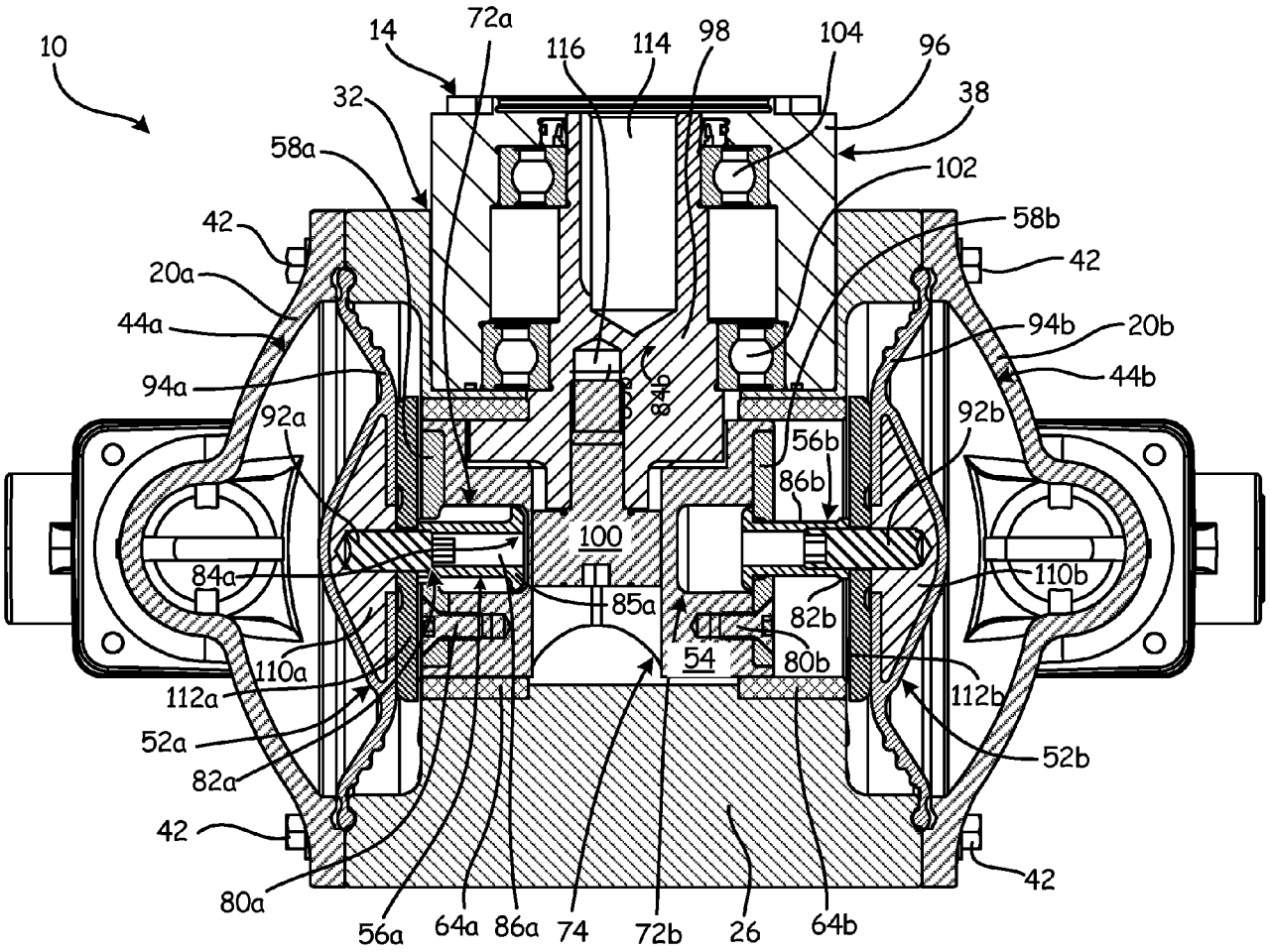
FIG. 4 is a top, cross-sectional view, along section 4-4 in FIG. 1, showing the connection of pump, drive system, and drive.

FIG. 4 is a top cross-sectional view, along line 4-4 of FIG. 1, showing the connection of drive system 14 and drive 38. FIG. 4 also depicts fluid covers 20*a* and 20*b*, and fluid displacement members 52*a* and 52*b*. Drive system 14 includes housing 26, piston 54, pulls 56*a* and 56*b*, face plates 58*a* and 58*b*, and bushings 64*a* and 64*b*. Housing 26 and fluid displacement members 52*a* and 52*b* define internal pressure chamber 66. Housing 26 includes drive chamber 32 and annular structure 62. Piston 54 includes pull chambers 72*a* and 72*b* and central slot 74. Pull 56*a* includes attachment end 82*a*, free end 84*a*, flange 85*a*, and pull shaft 86*a*, while pull 56*b* similarly includes attachment end 82*b*, free end 84*b*, flange 85*b*, and shaft 86*b*. Face plate 58*a* includes pull opening 90*a* and openings 88*a*. Similarly, face plate 58*b* includes pull opening 90*b* and openings 88*b*. In the present embodiment, drive 38 includes housing 96, crank shaft 98, cam follower 100, bearing 102, and bearing 104. Crank shaft 98 includes drive shaft chamber 114 and cam follower chamber 116.

Fluid cover 20*a* is attached to housing 26 by fasteners 42. Fluid displacement member 52*a* is secured between fluid cover 20*a* and housing 26. Fluid cover 20*a* and fluid displacement member 52*a* define fluid cavity 44*a*. Similarly, fluid cover 20*b* is attached to housing 26 by fasteners 42, and fluid displacement member 52*b* is secured between fluid cover 20*b* and housing 26. Fluid cover 20*b* and fluid displacement member 52*b* define fluid cavity 44*b*. Housing 26 and fluid displacement members 52*a* and 52*b* define internal pressure chamber 66.

In the present embodiment, fluid displacement member 52*a* is shown as a diaphragm and includes diaphragm 94*a*, first diaphragm plate 110*a*, second diaphragm plate 112*a*, and attachment screw 92*a*. Similarly, fluid displacement member 52*b* is shown as a diaphragm and includes diaphragm 94*b*, first diaphragm plate 110*b*, second diaphragm plate 112*b*, and attachment screw 92*b*. While fluid displacement members 52*a* and 52*b* are shown as diaphragms, it is understood that fluid displacement members 52*a* and 52*b* could also be pistons.

Piston 54 is mounted on bushings 64*a* and 64*b* within internal pressure chamber 66. Free end 84*a* of pull 56*a* is slidably secured within pull chamber 72*a* by face plate 58*a* and flange 85*a*. Shaft 86*a* extends through opening 90*a*, and attachment end 82*a* engages attachment screw 92*a*. Face plate 58*a* is secured to piston 54 by face plate fasteners 80*a* extending through openings 88*a* and into piston 54. Similarly, free end 84*b* of pull 56*b* is slidably secured within pull chamber 72*b* by face plate 58*b* and flange 85*b*. Pull shaft 86*b* extends through pull opening 90*b*, and attachment end 82*b* engages attachment screw 92*b*. Face plate 58*b* is attached to piston 54 by face plate fasteners 80*b* extending through openings 88*b* and into piston 54.

Drive 38 is mounted within drive chamber 32 of housing 26. Crank shaft 98 is rotatably mounted within housing 96 by bearing 102 and bearing 104. Crank shaft 98 is driven by a drive shaft (not shown) that connects to crank shaft 98 at drive shaft chamber 114. Cam follower 100 is mounted to crank shaft 98 opposite the drive shaft, and cam follower 100 is mounted at cam follower chamber 116. Cam follower 100 extends into internal pressure chamber 66 and engages central slot 74 of piston 54.

Drive 38 is driven by electric motor 12 (shown in FIG. 1), which rotates crank shaft 98 on bearings 102 and 104. Crank shaft 98 thereby rotates cam follower 100 about axis B-B, and cam follower 100 thus causes piston 54 to reciprocate along axis A-A. Because piston 54 has a predetermined lateral displacement, determined by the rotation of cam follower 100, the speed of the piston 54 can be sequenced with the pressure of the working fluid to eliminate downstream pulsation.

When cam follower 100 drives piston 54 towards fluid displacement member 52*b*, piston 54 pulls fluid displacement member 52*a* into a suction stroke via pull 56*a*. Flange 85*a* of pull 56*a* engages face plate 58*a* such that piston 54 causes pull 56*a* to also move towards fluid displacement member 52*b*, which causes pull 56*a* to pull fluid displacement member 52*a* into a suction stroke. Pull 56*a* pulls fluid displacement member 52*a* into a suction stroke through attachment end 82*a* being engaged with attachment screw 92*a*. At the same time, the pressurized working fluid within internal pressure chamber 66 pushes fluid displacement member 52*b* into a pumping stroke.

Figure 5:
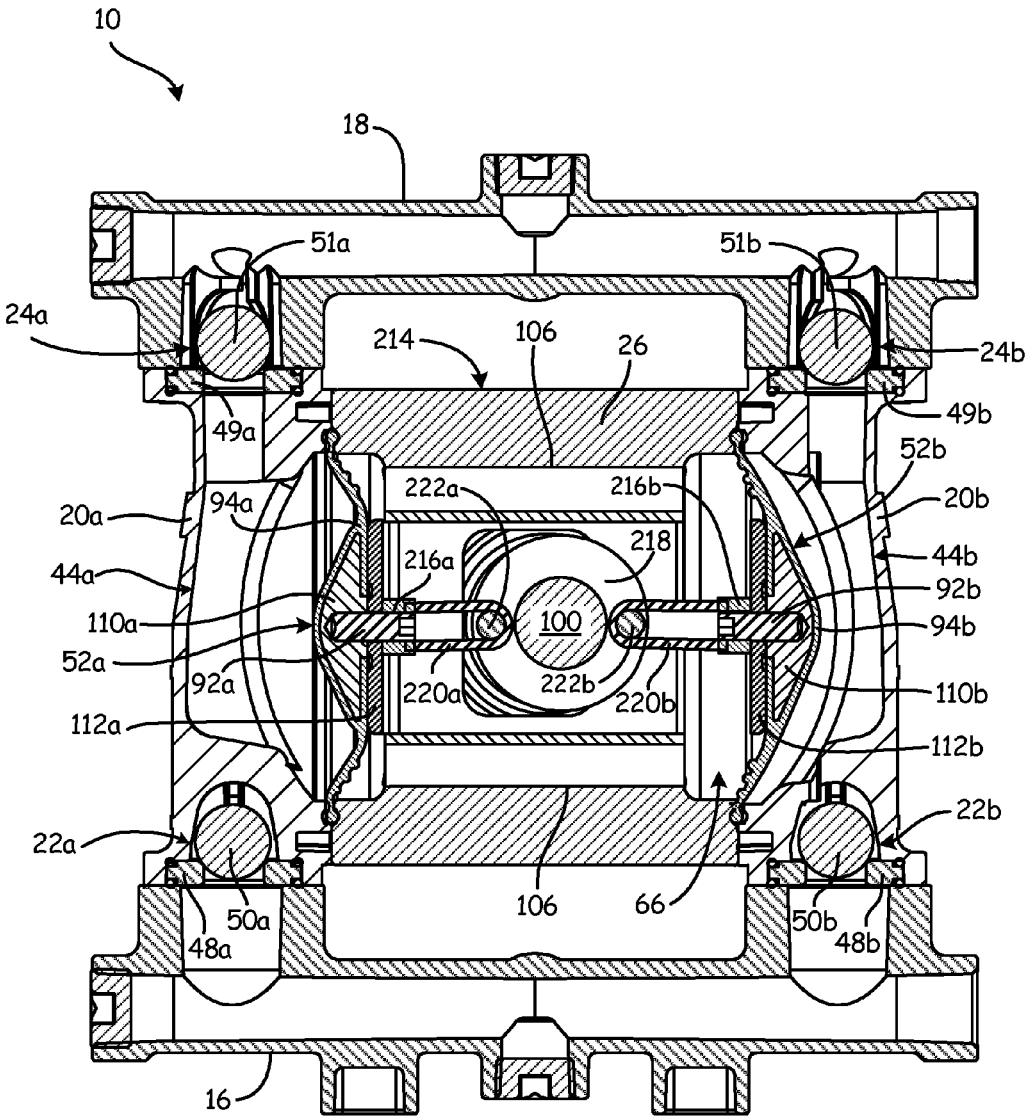
FIG. 5 is a cross-sectional view, along section 5-5 in FIG. 1, showing the connection of a pump, a drive system, and a drive.

FIG. 5 is a cross-sectional view, along section 5-5 of FIG. 1, showing the connection of pump 10, drive system 214, and cam follower 100. Pump 10 includes inlet manifold 16, outlet manifold 18, fluid covers 20*a* and 20*b*, inlet check valves 22*a* and 22*b*, outlet check valves 24*a* and 24*b*, and fluid displacement members 52*a* and 52*b*. Inlet check valve 22*a* includes seat 48*a* and check ball 50*a*, while inlet check valve 22*b* includes seat 48*b* and check ball 50*b*. Outlet check valve 24*a* includes seat 49*a* and check ball 51*a*, while outlet check valve 24*b* includes seat 49*b* and check ball 51*b*. In the present embodiment, fluid displacement member 52*a* includes diaphragm 94*a*, first diaphragm plate 110*a*, second diaphragm plate 112*a*, and attachment member 216*a*. Similarly, fluid displacement member 52*b* includes diaphragm 94*b*, first diaphragm plate 110*b*, second diaphragm plate 112*b*, and attachment member 216*b*. Drive system 214 includes housing 26, hub 218, flexible belts 220*a* and 220*b*, and pins 222*a* and 222*b*. Housing 26 defines internal pressure chamber 66.

Fluid cover 20*a* is affixed to housing 26, and fluid displacement member 52*a* is secured between fluid cover 20*a* and housing 26. Fluid cover 20*a* and fluid displacement member 52*a* define fluid cavity 44*a*, and fluid displacement member 52*a* sealingly separates fluid cavity 44*a* and internal pressure chamber 66. Fluid cover 20*b* is affixed to housing 26, and fluid displacement member 52*b* is secured between fluid cover 20*b* and housing 26. Fluid cover 20*b* and fluid displacement member 52*b* define fluid cavity 44*b*, and fluid displacement member 52*b* sealingly separates fluid cavity 44*b* and internal pressure chamber 66. Housing 26 includes openings 106 to allow working fluid to flow within internal pressure chamber 66.

Hub 218 is press-fit to cam follower 100. Pin 222*a* projects from a periphery of hub 218 along axis B-B. Similarly, pin 222*b* projects from a periphery of hub 218 along axis B-B and opposite pin 222*a*. Flexible belt 220*a* is attached to pin 222*a* and to attachment member 216*a*. Flexible belt 220*b* is attached to pin 222*b* and to attachment member 216*b*.

Cam follower 100 drives hub 218 along axis A-A. When hub 218 is drawn towards fluid cavity 44*b*, flexible belt 220*a* is also pulled towards fluid cavity 44*b* causing fluid displacement member 52*a* to enter a suction stroke due to the attachment of flexible belt 220*a* to attachment member 216*a* and pin 222*a*. Pulling fluid displacement member 52*a* causes the volume of fluid cavity 44*a* to increase, which draws process fluid through check valve 22*a* and into fluid cavity 44*a* from inlet manifold 16. Outlet check valve 24*a* prevents process fluid from being drawn into fluid cavity 44*a* from outlet manifold 18 during the suction stroke.

At the same time that process fluid is being drawn into fluid cavity 44*a*, the working fluid causes fluid displacement member 52*b* to enter a pumping stroke. The working fluid is charged to a higher pressure than that of the process fluid, which allows the working fluid to displace the fluid displacement member 52*a* or 52*b* that is not being drawn into a suction stroke by hub 218. Pushing fluid displacement member 52*b* into fluid cavity 44*b* reduces the volume of fluid cavity 44*b* and causes process fluid to be expelled from fluid cavity 44*b* through outlet check valve 24*b* and into outlet manifold 18. Inlet check valve 22*b* prevents process fluid from being expelled into inlet manifold 16 during a pumping stoke.

When cam follower 100 causes hub 218 to reverse direction and travel towards fluid cavity 44*a* pin 222*b* engages flexible belt 220*b*, and flexible belt 220*b* then pulls fluid displacement member 52*b* into a suction stroke causing process fluid to enter fluid cavity 44*b* from inlet manifold 16. At the same time, the working fluid now causes fluid displacement member 52*a* to enter a pumping stroke, thereby discharging process fluid from fluid cavity 44*a* through check valve 24*a* and into outlet manifold 18.

Flexible belts 220*a* and 220*b* allow outlet manifold 18 of pump 10 to be blocked during the operation of pump 10 without risking damage to pump 10, drive system 214, or electric motor 12 (shown in FIG. 1). When outlet manifold 18 is blocked, the pressure in fluid cavity 44*a* and fluid cavity 44*b* equals the pressure of the working fluid in internal pressure chamber 66. When such an over-pressure situation occurs, hub 218 will draw both fluid displacement member 52*a* and fluid displacement member 52*b* into a suction stroke. However, drive system 214 cannot push either fluid displacement member 52*a* or 52*b* into a pumping stroke because flexible belts 220*a* and 220*b* are not sufficiently rigid to impart a pushing force on either fluid displacement member 52*a* or 52*b*.

Figure 6:
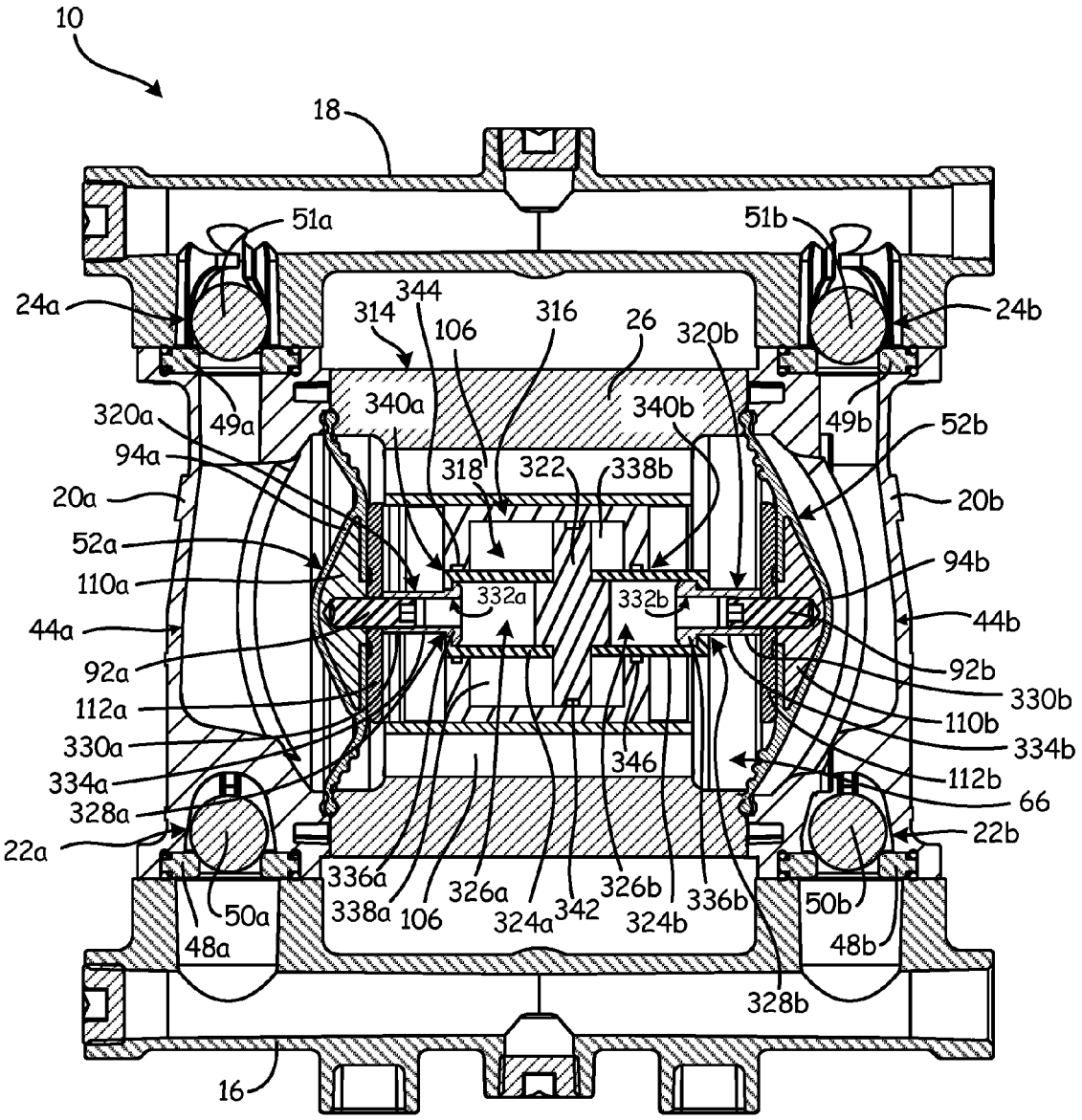
FIG. 6 is a cross-sectional view, along section 6-6 in FIG. 1, showing the connection of a pump, a drive system, and a drive.

FIG. 6 is a cross-sectional view, along section 6-6 of FIG. 1, showing the connection of pump 10 and drive system 314. Pump 10 includes inlet manifold 16, outlet manifold 18, fluid covers 20*a* and 20*b*, inlet check valves 22*a* and 22*b*, outlet check valves 24*a* and 24*b*, and fluid displacement members 52*a* and 52*b*. Inlet check valve 22*a* includes seat 48*a* and check ball 50*a*, while inlet check valve 22*b* includes seat 48*b* and check ball 50*b*. Outlet check valve 24*a* includes seat 49*a* and check ball 51*a*, while outlet check valve 24*b* includes seat 49*b* and check ball 51*b*. In the present embodiment, fluid displacement member 52*a* includes diaphragm 94*a*, first diaphragm plate 110*a*, and second diaphragm plate 112*a*, and attachment screw 92*a*. Similarly, fluid displacement member 52*b* includes diaphragm 94*b*, first diaphragm plate 110*b*, and second diaphragm plate 112*b*, and attachment screw 92*b*.

Drive system 314 includes housing 26, second housing 316, piston 318, and pulls 320*a* and 320*b*. Piston 318 includes reciprocating member 322 and pull housings 324*a* and 324*b*. Pull housing 324*a* defines pull chamber 326*a* and includes pull opening 328*a*. Pull housing 324*b* defines pull chamber 326*b* and includes pull opening 328*b*. Pull 320*a* includes attachment end 330*a*, free end 332*a* and pull shaft 334*a* extending between free end 332*a* and attachment end 330*a*. Free end 332*a* includes flange 336*a*. Similarly, pull 320*b* includes attachment end 330*b*, free end 332*b*, and pull shaft 334*b* extending between free end 332*b* and attachment end 330*b*, and free end 332*b* includes flange 336*b*. Second housing 316 includes pressure chamber 338*a* and pressure chamber 338*b*, aperture 340*a*, aperture 340*b*, first o-ring 342, second o-ring 344, and third o-ring 346.

Fluid cover 20*a* is affixed to housing 26, and fluid displacement member 52*a* is secured between fluid cover 20*a* and housing 26. Fluid cover 20*a* and fluid displacement member 52*a* define fluid cavity 44*a*, and fluid displacement member 52*a* sealingly separates fluid cavity 44*a* and internal pressure chamber 66. Fluid cover 20*b* is affixed to housing 26, and fluid displacement member 52*b* is secured between fluid cover 20*b* and housing 26. Fluid cover 20*b* and fluid displacement member 52*b* define fluid cavity 44*b*, and fluid displacement member 52*b* sealingly separates fluid cavity 44*b* and internal pressure chamber 66.

Second housing 316 is disposed within housing 26. Piston 318 is disposed within second housing 316. First o-ring 342 is disposed around reciprocating member 322, and first o-ring 342 and reciprocating member 322 sealingly separate pressure chamber 338*a* and pressure chamber 338*b*. Pull housing 324*a* extends from reciprocating member 322 through aperture 340*a* and into internal pressure chamber 66. Pull housing 324*b* extends from reciprocating member 322 through aperture 340*b* and into internal pressure chamber 66. Second o-ring 344 is disposed around pull housing 324*a* at aperture 340*a*. Second o-ring 344 sealingly separates pressure chamber 338*a* from internal pressure chamber 66. Third o-ring 346 is disposed around pull housing 324*b* at aperture 340*b*. Third o-ring 346 sealingly separates pressure chamber 338*b* from internal pressure chamber 66.

Free end 332*a* of pull 320*a* is slidably secured within pull chamber 326*a* by flange 336*a*. Pull shaft 334*a* extends through pull opening 328*a*, and attachment end 330*a* engages attachment screw 92*a*. Similarly, free end 332*b* of pull 320*b* is slidably secured within pull chamber 326*b* by flange 336*b*. Pull shaft 334*b* extends through pull opening 328*b*, and attachment end 330*b* engages attachment screw 92*b*.

Piston 318 is reciprocatingly driven within second housing 316 by alternatingly providing pressurized fluid to pressure chamber 338*a* and pressure chamber 338*b*. The pressurized fluid can be compressed air, non-compressible hydraulic fluid, or any other fluid suitable for driving piston 318. First o-ring 342 sealingly separates pressure chamber 338*a* and pressure chamber 338*b*, which allows the pressurized fluid to reciprocatingly drive piston 318. When pressurized fluid is provided to pressure chamber 338*a*, second o-ring 344 sealingly separates the pressurized fluid from the working fluid disposed within internal pressure chamber 66. Similarly, when pressurized fluid is provided to pressure chamber 338*b*, third o-ring 346 sealingly separates the pressurized fluid from the working fluid disposed within internal pressure chamber 66.

When pressure chamber 338*a* is pressurized, piston 318 is driven towards fluid displacement member 52*b*. Pull 320*a* is thereby also drawn towards fluid displacement member 52*b* due to flange 336*a* engaging pull housing 324*a*. Pull 320*a* causes fluid displacement member 52*a* to enter into a suction stroke due to the connection between attachment end 330*a* and attachment screw 92*a*. At the same time, the working fluid in internal pressure chamber 66 pushes fluid displacement member 52*b* into a pumping stroke. During this stroke, pull chamber 326*b* prevents piston 318 from pushing fluid displacement member 52*b* into a pumping stroke.

The stroke is reversed when pressure chamber 338*b* is pressurized, thereby driving piston 318 towards fluid displacement member 52*a*. In this stroke, pull 320*b* is drawn towards fluid displacement member 52*a* due to flange 336*b* engaging pull housing 324*b*. Pull 320*b* causes fluid displacement member 52*b* to enter into a suction stroke due to the connection between attachment end 330*b* and attachment screw 92*b*. While fluid displacement member 52*b* is drawn into a suction stroke, the working fluid in internal pressure chamber 66 pushes fluid displacement member 52*a* into a pumping stroke. Similar to pull chamber 326*b*, pull chamber 326*a* prevents piston 318 from pushing fluid displacement member 52*a* into a pumping stroke.

Figure 7:
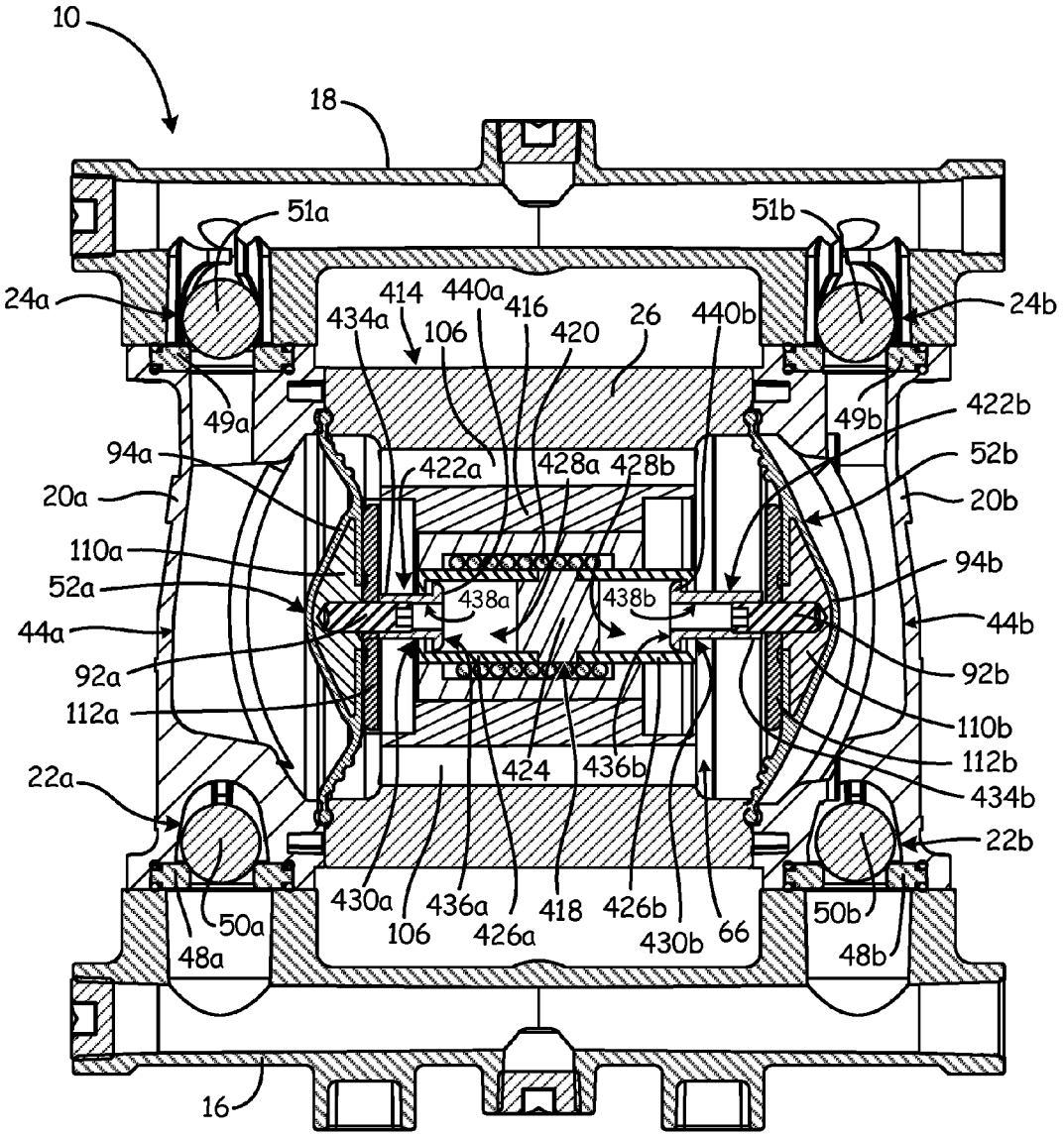
FIG. 7 is a cross-sectional view, along section 7-7 in FIG. 1, showing the connection of a pump, a drive system, and a drive.

FIG. 7 is a cross-sectional view, along section 7-7 of FIG. 1, showing the connection of pump 10 and drive system 414. Pump 10 includes inlet manifold 16, outlet manifold 18, fluid covers 20*a* and 20*b*, inlet check valves 22*a* and 22*b*, outlet check valves 24*a* and 24*b*, and fluid displacement members 52*a* and 52*b*. Inlet check valve 22*a* includes seat 48*a* and check ball 50*a*, while inlet check valve 22*b* includes seat 48*b* and check ball 50*b*. Outlet check valve 24*a* includes seat 49*a* and check ball 51*a*, while outlet check valve 24*b* includes seat 49*b* and check ball 51*b*. In the present embodiment, fluid displacement member 52*a* includes diaphragm 94*a*, first diaphragm plate 110*a*, and second diaphragm plate 112*a*, and attachment screw 92*a*. Similarly, fluid displacement member 52*b* includes diaphragm 94*b*, first diaphragm plate 110*b*, and second diaphragm plate 112*b*, and attachment screw 92*b*.

Drive system 414 includes housing 26, second housing 416, reciprocating member 418, solenoid 420, and pulls 422*a* and 422*b*. Reciprocating member 418 includes armature 424 and pull housings 426*a* and 426*b*. Pull housing 426*a* defines pull chamber 428*a* and includes pull opening 430*a*. Pull housing 426*b* defines pull chamber 428*b* and includes pull opening 430*b*. Pull 422*a* includes attachment end 434*a*, free end 436*a*, and pull shaft 438*a* extending between attachment end 434*a* and free end 436*a*. Free end 436*a* includes flange 440*a*. Similarly, pull 422*b* includes attachment end 434*b*, free end 436*b*, and pull shaft 438*b* extending between attachment end 434*b* and free end 436*b*. Free end 436*b* includes flange 440*b*.

Fluid cover 20*a* is affixed to housing 26, and fluid displacement member 52*a* is secured between fluid cover 20*a* and housing 26. Fluid cover 20*a* and fluid displacement member 52*a* define fluid cavity 44*a*, and fluid displacement member 52*a* sealingly separates fluid cavity 44*a* and internal pressure chamber 66. Fluid cover 20*b* is affixed to housing 26, and fluid displacement member 52*b* is secured between fluid cover 20*b* and housing 26. Fluid cover 20*b* and fluid displacement member 52*b* define fluid cavity 44*b*, and fluid displacement member 52*b* sealingly separates fluid cavity 44*b* and internal pressure chamber 66.

Reciprocating member 418 is disposed within solenoid 420. Pull housing 426*a* is integrally attached to a first end armature 424, and pull housing 426*b* is integrally attached to a second end of armature 424 opposite pull housing 426*a*. Free end 436*a* of pull 422*a* is slidably secured within pull chamber 428*a* by flange 440*a*. Pull shaft 438*a* extends through pull opening 430*a*, and attachment end 434*a* engages attachment screw 92*a*. Similarly, free end 436*b* of pull 422*b* is slidably secured within pull chamber 428*b* by flange 440*b*. Pull shaft 438*b* extends through pull opening 430*b*, and attachment end 434*b* engages attachment screw 92*b*.

Solenoid 420 reciprocatingly drives armature 424, which thereby reciprocatingly drives pull housing 426*a* and pull housing 426*b*.

The strokes are reversed by solenoid 420 driving armature 424 in an opposite direction from the initial stroke. In this stroke, pull housing 426*b* engages flange 440*b* of pull 422*b*, and pull 422*b* thereby draws fluid displacement member 52*b* into a suction stroke. At the same time, the working fluid in internal pressure chamber 66 pushes fluid displacement member 52*a* into a pumping stroke. During the pumping stroke of fluid displacement member 52*a*, pull chamber 428*a* prevents pull 422*a* from exerting any pushing force on fluid displacement member 52*a*.

The pump 10 and drive system 14 described herein provide several advantages. Drive system 14 eliminates the need for downstream dampeners or surge suppressors because the drive system 14 provides a pulseless flow of process fluid when piston 54 is sequenced. Downstream pulsation is eliminated because when one fluid displacement member 52*a* or 52*b* is changing over from one stroke, the other fluid displacement member 52*a* or 52*b* is already displacing process fluid. This eliminates any rest within the pump 10, which eliminates pulsation because fluid is being constantly discharged, at a constant rate. So long as the working fluid pressure remains slightly greater than the process fluid pressure, the drive system 14 is self-regulating and provides a constant downstream flow rate.

The working fluid pressure determines the maximum process fluid pressures that occur when the downstream flow is blocked or deadheaded. If outlet manifold 18 is blocked, motor 12 can continue to run without damaging motor 12, drive system 14, or pump 10. Pull chambers 72*a* and 72*b* ensure that the drive system 14 will not cause over pressurization, by preventing piston 54 from exerting any pushing force on either fluid displacement member 52*a* or 52*b*. This also eliminates the need for downstream pressure relief valves, because the pump 10 is self-regulating and will not cause an over-pressurization event to occur. This pressure control feature serves as a safety feature and eliminates the possibility of over-pressurization of process fluids, potential pump damage, and excessive motor loads.

When drive system 14 is used with diaphragm pumps, the drive system 14 provides for equalized balanced forces on the diaphragms, from both the working fluid and the process fluid, which allows for longer diaphragm life and use with higher pressure applications over mechanically-driven diaphragm pumps. Pump 10 also provides better metering and dosing capabilities due to the constant pressure on and shape of fluid displacement members 52*a* and 52*b*.

When compressed air is used as the working fluid, drive system 14 eliminates the possibility of exhaust icing, as can be found in air-driven pumps, because the compressed air in drive system 14 is not exhausted after each stroke. Other exhaust problems are also eliminated, such as safety hazards that arise from exhaust becoming contaminated with process fluids. Additionally, higher energy efficiency can be achieved with drive system 14 because the internal pressure chamber 66 eliminates the need to provide a fresh dose of compressed air during each stroke, as is found in typical air operated pumps. When a non-compressible hydraulic fluid is used as the working fluid drive system 14 eliminates the need for complex hydraulic circuits with multiple compartments, as can be found in typical hydraulically driven pumps. Additionally, drive system 14 eliminates the contamination risk between the process fluid and the working fluid due to the balanced forces on either side of fluid displacement members 52*a* and 52*b*.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A pump comprising:

a process fluid flowpath comprising:

an inlet manifold;

an outlet manifold;

a first fluid cavity disposed between the inlet manifold and the outlet manifold;

a second fluid cavity disposed between the inlet manifold and the outlet manifold;

a first inlet check valve disposed between the first fluid cavity and the inlet manifold and a second inlet check valve disposed between the second fluid cavity and the inlet manifold; and a first outlet check valve disposed between the first fluid cavity and the outlet manifold and a second outlet check valve disposed between the second fluid cavity and the outlet manifold;

an internal pressure chamber configured to be filled with a working fluid;

a drive extending into the internal pressure chamber;

a piston disposed within the internal pressure chamber and attached to the drive, the piston having a first end and a second end disposed opposite the first end, wherein the piston further comprises a first pull chamber extending into the first end of the piston and a second pull chamber extending into the second end of the piston;

a first pull having a first attachment end and a first free end, wherein the first free end is retained within the first pull chamber and the first attachment end is secured to a first fluid displacement member sealingly disposed between the internal pressure chamber and the first fluid cavity, and wherein the first free end is movable within the first pull chamber and the first pull is movable relative to the piston and the first pull chamber; and a second pull having a second attachment end and a second free end, wherein the second free end is retained within the second pull chamber and the second attachment end is secured to a second fluid displacement member sealingly disposed between the internal pressure chamber and the second fluid cavity, wherein the second free end is movable within the second pull chamber and the second pull is movable relative to the piston and the second pull chamber.

2. The pump of claim 1, wherein the working fluid comprises compressed gas.

3. The pump of claim 1, wherein the working fluid comprises a non-compressible hydraulic fluid.

4. The pump of claim 1, wherein the first pull chamber and the second pull chamber are configured to house the first pull and the second pull, respectively, such that the piston cannot exert a pushing force on either the first fluid displacement member or the second fluid displacement member.

5. The pump of claim 1, wherein the piston pulls the first pull in a first direction and the first pull pulls the first fluid displacement member in the first direction during a suction stroke of the first fluid displacement member and wherein the first piston cannot exert a pushing force on the first pull in an operating condition where a pressure in the process fluid exceeds a pressure in the working fluid such that the first pull is incapable of transmitting a pushing force to the first fluid displacement member in the operating condition.

* * * * *